US011754282B2

(12) United States Patent
Zink et al.

(10) Patent No.: US 11,754,282 B2
(45) Date of Patent: Sep. 12, 2023

(54) LEAN PRE-MIX RADIANT WALL BURNER APPARATUS AND METHOD

(71) Applicant: ZEECO, INC., Broken Arrow, OK (US)

(72) Inventors: Darton J. Zink, Tulsa, OK (US); Austin White, Tulsa, OK (US); Rex K. Isaacs, Collinsville, OK (US); John Petersen, Pawnee, OK (US); Tim Kirk, Morris, OK (US)

(73) Assignee: ZEECO, INC., Broken Arrow, OK (US)

( * ) Notice: Subject to any disclaimer, the term of this patent is extended or adjusted under 35 U.S.C. 154(b) by 196 days.

(21) Appl. No.: 17/355,768

(22) Filed: Jun. 23, 2021

(65) Prior Publication Data

US 2022/0412551 A1 Dec. 29, 2022

(51) Int. Cl.

| | |
|---|---|
| ***F23D 14/12*** | (2006.01) |
| ***F23D 14/64*** | (2006.01) |
| ***F23D 14/58*** | (2006.01) |
| ***F23D 14/02*** | (2006.01) |

(52) U.S. Cl.

CPC ..... *F23D 14/12* (2013.01); *F23D 14/02* (2013.01); *F23D 14/58* (2013.01); *F23D 14/64* (2013.01); *F23D 2203/002* (2013.01)

(58) Field of Classification Search

CPC ..... F23D 14/125; F23D 14/04; F23D 14/06; F23D 14/02; F23D 14/12; F23D 14/58; F23D 14/64

USPC ..... 431/348, 177, 354

See application file for complete search history.

(56) References Cited

U.S. PATENT DOCUMENTS

| | | | | |
|---|---|---|---|---|
| 1,234,088 A | | 7/1917 | Ralston | |
| 2,643,916 A | | 6/1953 | White et al. | |
| 2,671,507 A | | 3/1954 | Morck | |
| 2,808,876 A | | 10/1957 | Loof | |
| 3,000,435 A | | 9/1961 | Bloom et al. | |
| 3,182,712 A | * | 5/1965 | Zink | F23D 14/125 431/348 |
| 3,198,436 A | | 8/1965 | Kurzinski et al. | |
| 3,639,095 A | | 2/1972 | Zink et al. | |
| 3,644,076 A | | 2/1972 | Bagge | |
| 3,737,105 A | | 6/1973 | Arnold et al. | |
| 3,954,382 A | | 5/1976 | Hirose | |
| 4,014,654 A | | 3/1977 | Howell | |
| 4,237,858 A | | 12/1980 | Goodnight et al. | |
| 4,257,762 A | | 3/1981 | Zink et al. | |

(Continued)

OTHER PUBLICATIONS

Lanemark International, "Printout re KS6000 Series Radiant Wall Burner", Publisher: Internet Printout, Published in: UK.

(Continued)

*Primary Examiner* — Vivek K Shirsat

(74) *Attorney, Agent, or Firm* — Dennis D. Brown; Brown Patent Law, P.L.L.C.

(57) ABSTRACT

A staged, lean pre-mix radiant wall burner having an internal staged fuel discharge tip and an internal flow diverter, and a method of using the radiant wall burner, which allow the combustion of a high hydrogen content fuel without the occurrence of flashbacks and which also provide reduced $NO_x$ emissions and allow a closer spacing of the burners when installed in a wall, floor, or ceiling of a fired heater in a multiple burner arrangement.

19 Claims, 3 Drawing Sheets

(56) References Cited

U.S. PATENT DOCUMENTS

| | | | | |
|---|---|---|---|---|
| 4,257,763 | A | 3/1981 | Reed | |
| 4,289,474 | A | 9/1981 | Honda et al. | |
| 4,412,808 | A | 11/1983 | Sheppard et al. | |
| 4,428,727 | A | 1/1984 | Deussner et al. | |
| 4,505,666 | A | 3/1985 | Martin et al. | |
| 4,702,691 | A * | 10/1987 | Ogden | F23D 14/125 239/553 |
| 4,945,841 | A | 8/1990 | Nakamachi et al. | |
| 5,044,931 | A | 3/1991 | Van Eerden et al. | |
| 5,180,302 | A * | 1/1993 | Schwartz | F23D 14/00 431/278 |
| 5,680,823 | A | 10/1997 | LaRose | |
| 5,957,678 | A | 9/1999 | Endoh et al. | |
| 5,975,886 | A | 11/1999 | Philippe | |
| 5,980,243 | A | 11/1999 | Surbey et al. | |
| 6,379,146 | B1 * | 4/2002 | Zink | F23D 14/70 239/548 |
| 6,499,990 | B1 | 12/2002 | Zink et al. | |
| 6,979,191 | B1 | 12/2005 | Zink et al. | |
| 9,194,579 | B2 | 11/2015 | Martin et al. | |
| 10,240,779 | B2 | 3/2019 | Martin | |
| 11,105,502 | B2 * | 8/2021 | Martin | F23D 14/60 |
| 2003/0148236 | A1 | 8/2003 | Joshi et al. | |

OTHER PUBLICATIONS

Zeeco, Inc., "Printout re RW Premixed Radiant Wall Burner", Publisher: Internet Printout, Published in US.

Zeeco, Inc., "Printout re Radiant Wall Burner RW Series", Publisher: Internet Printout, Published in US.

Zeeco, Inc., "Printout re RWFD Forced Draft Radiant Wall Burner", Publisher: Internet Printout, Published in US.

Nao, Inc., "Printout re NAO Radiant Wall Burner—Glowall", Publisher: Internet Printout, Published in US.

John Zink Hamworthy Combustion, "Printout re Radiant Wall Burners/Flame Patterns", Publisher: Internet Printout, Published in US.

PCT International Search Report and Written Opinion; PCT/US 22/34499; dated Oct. 7, 2022; US.

Low NOx Burner Maintenance in High Temperature Furnaces By Jason McAdams, Jay Karan, Roger Witte, Mike Claxton—John Zink Company, LLC Tulsa, OK—1981.

* cited by examiner

LEAN PRE-MIX RADIANT WALL BURNER APPARATUS AND METHOD

FIELD OF THE INVENTION

The present invention relates to pre-mix, reduced $NO_x$, radiant wall burner apparatuses and methods for heaters, furnaces, and other fired heating systems used in refineries and chemical plants, and in other industrial services and facilities.

BACKGROUND OF THE INVENTION

Radiant wall burners are commonly used in ethylene cracking furnaces and are also used in delayed coking heaters, in steam/methane reforming furnaces for producing hydrogen, and in other applications. In these applications, multiple radiant wall burners are typically installed in one, two, or more walls of the furnace firebox in order to heat the entire wall and to radiate heat to the process tubes. Pre-mix radiant wall burners form and radially discharge a mixture of gas fuel and air to produce a flat flame which surrounds the burner tip and lies against or close to the surface of the firebox wall. Radiant wall burners are commonly installed horizontally, such as in a vertical firebox wall, but can also be installed vertically or in other orientations.

A problem which is commonly encountered with pre-mix radiant wall burners is "flashback". Flashback occurs when the flame speed of the gas fuel is greater than the discharge velocity of the fuel and air pre-mix, which results in the pre-mix being ignited while it is still inside the burner. Most pre-mix radiant wall burners comprise a series of longitudinally extending discharge slots which surround the burner tip. The flow area of the burner can be increased by increasing the longitudinal length of the slots. However, as the length of the slots increases, the relative flow velocity of the pre-mix discharged from the rearward end portions of the longitudinally extending slots decreases, thus creating a low velocity area which increases the danger of flashbacks.

In addition, because hydrogen burns so rapidly as compared to other gas fuels, flashback generally has a greater tendency to occur as the hydrogen content of the pre-mix fuel increases. This is particularly problematic, for example, when using pre-mix radiant wall burners in ethylene cracking processes. In the ethylene cracking market, approximately 39% of all ethylene crackers are gas crackers which have up to 90% $H_2$ in the burner fuel.

Another limitation that is commonly encountered with pre-mix radiant wall burners is that, in order to avoid flame interference as a result of the diameter of the burner flame, the burners must typically be spaced at least five feet or more than five feet apart. This limitation is encountered with both non-staged and staged radiant wall burners but is particularly problematic with the staged fuel radiant wall burners which are currently known in the art. The staged fuel operation used in these existing burners desirably reduces $NO_x$ emissions but increases the diameter of the burner flame so that the required spacing of the burners is increased.

Consequently, a need exists for an improved pre-mix radiant wall burner which (a) eliminates low velocity discharge areas for the fuel and air pre-mix, (b) allows the use of high hydrogen fuels without the occurrence of flashbacks, and (c) provides staged fuel operation with a reduced diameter flame which reduces the required spacing between the burners when installed in the firebox wall.

In addition, there is also a need for an improved pre-mix radiant wall burner of the type described above which provides low $NO_x$ emissions.

For burners which are used in industrial applications, if the burner fuel is thoroughly mixed with air and combustion occurs under ideal conditions, the resulting combustion products are primarily carbon dioxide and water vapor. However, when the fuel is not burned under ideal conditions, e.g., at a high flame temperature, nitrogen present in the combustion air reacts with oxygen to produce nitrogen oxides ($NO_x$). Other conditions being equal, $NO_x$ production increases as the temperature of the combustion process increases. $NO_x$ emissions are generally considered to contribute to ozone depletion, acid rain, smog, and other environmental problems.

For gaseous fuels with no fuel bound nitrogen, thermal $NO_x$ is the primary mechanism for $NO_x$ production. Thermal $NO_x$ is produced when the flame reaches a high enough temperature to break the covalent $N_2$ bond so that the resulting "free" nitrogen atoms bond with oxygen to form $NO_x$.

Typically, the temperature of combustion is not great enough to break all of the $N_2$ bonds. Rather, most of the nitrogen in the air stream remains in the form of diatomic nitrogen ($N_2$) throughout the combustion process. However, some of the $N_2$ will typically reach a high enough temperature in the high intensity regions of the flame to break the $N_2$ bond and form "free" nitrogen. Once the covalent nitrogen bond is broken, the "free" nitrogen is available to bond with other atoms. Fortunately, the free nitrogen will most likely react with other free nitrogen atoms to convert back $N_2$. However, if another free nitrogen atom is not available, the free nitrogen will react with oxygen to form $NO_x$.

As the temperature of the burner flame increases, the stability of the $N_2$ covalent bond decreases, causing increasing production of free nitrogen, and thus also increasing the production of thermal $NO_x$ emissions. Consequently, in an ongoing effort to reduce $NO_x$ emissions, various types of burner designs and theories have been developed with the objective of reducing the peak flame temperature.

The varied requirements of refining, power generation, petrochemical processes, and other processes necessitate the use of numerous different types and configurations of burners. The approaches used to lower $NO_x$ emissions can differ from application to application. However, thermal $NO_x$ reduction is generally achieved by slowing the rate of combustion. Since the combustion process is a reaction between oxygen and the burner fuel, the objective of delayed combustion is typically to reduce the rate at which the fuel and oxygen mix together and burn. The faster the oxygen and the fuel mix together, the faster the rate of combustion and the higher the peak flame temperature.

Examples of different types of burner design approaches used for reducing $NO_x$ emissions have included:

(a) Staged air designs wherein the combustion air is typically separated into two or more flows to create separate stages of lean and rich combustion.

(b) Designs using Internal Flue Gas Recirculation (IFGR) wherein internal flow momentum is used to cause some of the flue gas (i.e., the inert products of combustion) in the combustion system to recirculate back into the combustion zone to form a diluted combustion mixture which burns at a lower peak flame temperature.

(c) Staged fuel designs wherein (i) all or part of the fuel is introduced outside of the combustion air stream to thus delay the mixing of the fuel with the combustion air stream, creating a fuel-air mixture which burns at a lower peak flame temperature or (ii) part of the fuel is introduced outside of the primary flame envelope to stage the flame and combust the fuel in the presence of the products of combustion from the primary flame.

(d) Designs using External Flue Gas Recirculation (EFGR) wherein the burner typically uses an external air blower which supplies combustion air to the burner, and which uses an external piping arrangement to draw flue gas from the combustion chamber into the suction of the blower. The flue gas mixes with the combustion air stream to reduce the oxygen concentration of the air stream supplied to the burner, which in turn lowers the peak flame temperature.

(e) Designs using "flameless" combustion wherein most, or all, of the burner fuel passes through and mixes with inert products of combustion to form a diluted fuel which burns at a lower peak flame temperature. The mixture of fuel and inert products of combustion can be as high as 90% inert, thus resulting in a "transparent" flame.

(f) Designs using steam and/or inert injection into the burner fuel wherein the steam or inert component mixes with the fuel so that the resulting composition will burn at a lower peak flame temperature.

(g) Designs using steam and/or inert injection into the combustion air stream wherein the steam and/or inert components mix with the combustion air so that the resulting composition will burn at a lower peak flame temperature.

(h) Designs using high excess air levels to dilute products of combustion and produce low flame temperatures, such as surface stabilized combustion burners.

SUMMARY OF THE INVENTION

The present invention provides a low $NO_x$, staged fuel, pre-mix radiant wall burner apparatus and method which satisfy the needs and alleviate the problems discussed above. The inventive pre-mix radiant wall burner and method (a) will operate with over 90 volume % hydrogen in the burner fuel without flashbacks, (b) produce $NO_x$ emissions of only about 22 ppmv at a furnace temperature of 2,230° F., (c) eliminate low discharge velocity areas in the burner tip, (d) provide a staged fuel operation which reduces $NO_x$ emissions while also reducing the diameter of the burner flame and allowing a burner spacing of less than five feet, and (e) provides a more even flame profile which is better for heating.

In one aspect, there is provided a radiant wall burner which preferably comprises a primary fuel tip assembly comprising: (i) a longitudinal axis, (ii) a venturi having a longitudinally rearward inlet end and a longitudinally forward discharge end, (iii) a radial discharge tip positioned on or forwardly of the longitudinally forward discharge end of the venturi, (iv) the radial discharge tip having a closed longitudinally forward end and a longitudinally extending side wall which surrounds the longitudinal axis, and (v) a plurality of surrounding openings, formed through the longitudinally extending side wall of the radial discharge tip, which surround the longitudinal axis. In addition, the radiant wall burner preferably also comprises a primary fuel ejector and a staged fuel discharge tip. The primary fuel ejector preferably ejects a primary gas fuel stream forwardly into the venturi and draws an air stream into the longitudinally rearward inlet end of the venturi which mixes with the primary gas fuel stream to form a pre-mix stream. The staged fuel discharge tip, which discharges a staged gas fuel stream, is preferably positioned in the interior of the primary fuel tip assembly longitudinally forward of the primary fuel ejector and longitudinally rearward of the closed longitudinally forward end of the radial discharge tip.

In another aspect, there is provided a radiant wall burner which preferably comprises a primary fuel tip assembly comprising: (i) a longitudinal axis, (ii) a venturi having a longitudinally rearward inlet end and a longitudinally forward discharge end, (iii) a radial discharge tip positioned on or forwardly of the longitudinally forward discharge end of the venturi, (iv) the radial discharge tip having a closed longitudinally forward end and a longitudinally extending side wall which surrounds the longitudinal axis, and (v) a longitudinal series of rows of surrounding slots formed through the side wall of the radial discharge tip, each of said rows of surrounding slots surrounding the longitudinal axis and each of said rows of surrounding slots lying in a different plane which is substantially perpendicular to the longitudinal axis such that, when the longitudinal axis is vertically positioned, the surrounding slots in each of said rows of surrounding slots are substantially horizontal. In addition, the radiant wall burner preferably also comprises a primary fuel ejector, a flow diverter in the interior of the radial discharge tip, and a staged fuel discharge tip which discharges a staged gas fuel stream. The primary fuel ejector preferably ejects a primary gas fuel stream forwardly into the venturi and draws an air stream into the longitudinally rearward inlet end of the venturi which mixes with the primary gas fuel stream to form a pre-mix stream. The flow diverter preferably comprises a deflecting wall which (i) extends rearwardly in the interior of the radial discharge tip, (ii) converges radially inward toward the longitudinal axis as it extends rearwardly, and (iii) is laterally surrounded by at least some, preferably all, of the rows of surrounding slots. The staged fuel discharge tip is preferably positioned in the interior of the primary fuel tip assembly longitudinally forward of the primary fuel ejector and longitudinally rearward of the deflecting wall of the flow diverter.

In another aspect, there is provided a method of operating a radiant wall burner having a primary fuel tip assembly comprising (i) a longitudinal axis, (ii) a venturi having a longitudinally rearward inlet end and a longitudinally forward discharge end, (iii) a radial discharge tip positioned on or forwardly of the longitudinally forward discharge end of the venturi, (iv) the radial discharge tip having a closed longitudinally forward end and a longitudinally extending side wall which surrounds the longitudinal axis, and (v) the side wall of the radial discharge tip having a longitudinally extending radial discharge segment formed therein which surrounds the longitudinal axis. The method preferably comprises discharging from a longitudinally rearward portion of the radial discharge segment a fuel-lean gas fuel and air mixture comprising more than a stoichiometric amount of oxygen, and discharging from a longitudinally forward portion of the radial discharge segment a fuel rich flow comprising less than a stoichiometric amount of or no oxygen. This is preferably done by (a) forwardly ejecting, from a primary fuel ejector, a primary gas fuel stream into the longitudinally rearward inlet end of a venturi, the ejection of the primary gas fuel stream drawing an air stream into the longitudinally rearward inlet end of the venturi which mixes with the primary gas fuel stream to form a lean pre-mix stream, (b) forwardly discharging from a staged fuel discharge tip, located in the interior of the primary fuel tip assembly, a staged gas fuel stream, the staged fuel discharge tip being positioned longitudinally forward of the primary fuel ejector and longitudinally rearward of a flow diverter in the interior of the radial discharge tip, and (c) deflecting, from a deflecting wall of the flow diverter, the lean pre-mix stream and the staged gas fuel stream outwardly, at an angle away from the longitudinal axis, in the interior of the radial discharge tip toward the longitudinally extending radial discharge segment.

Further aspects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Before explaining the present invention in detail, it is important to understand that the invention is not limited in its application to the details of the preferred embodiments and steps described herein. The invention is capable of other embodiments and of being practiced or carried out in a variety of ways. It is to be understood that unless expressly indicated, the phraseology and terminology employed herein are for purposes of description and not of limitation.

Figure 1:
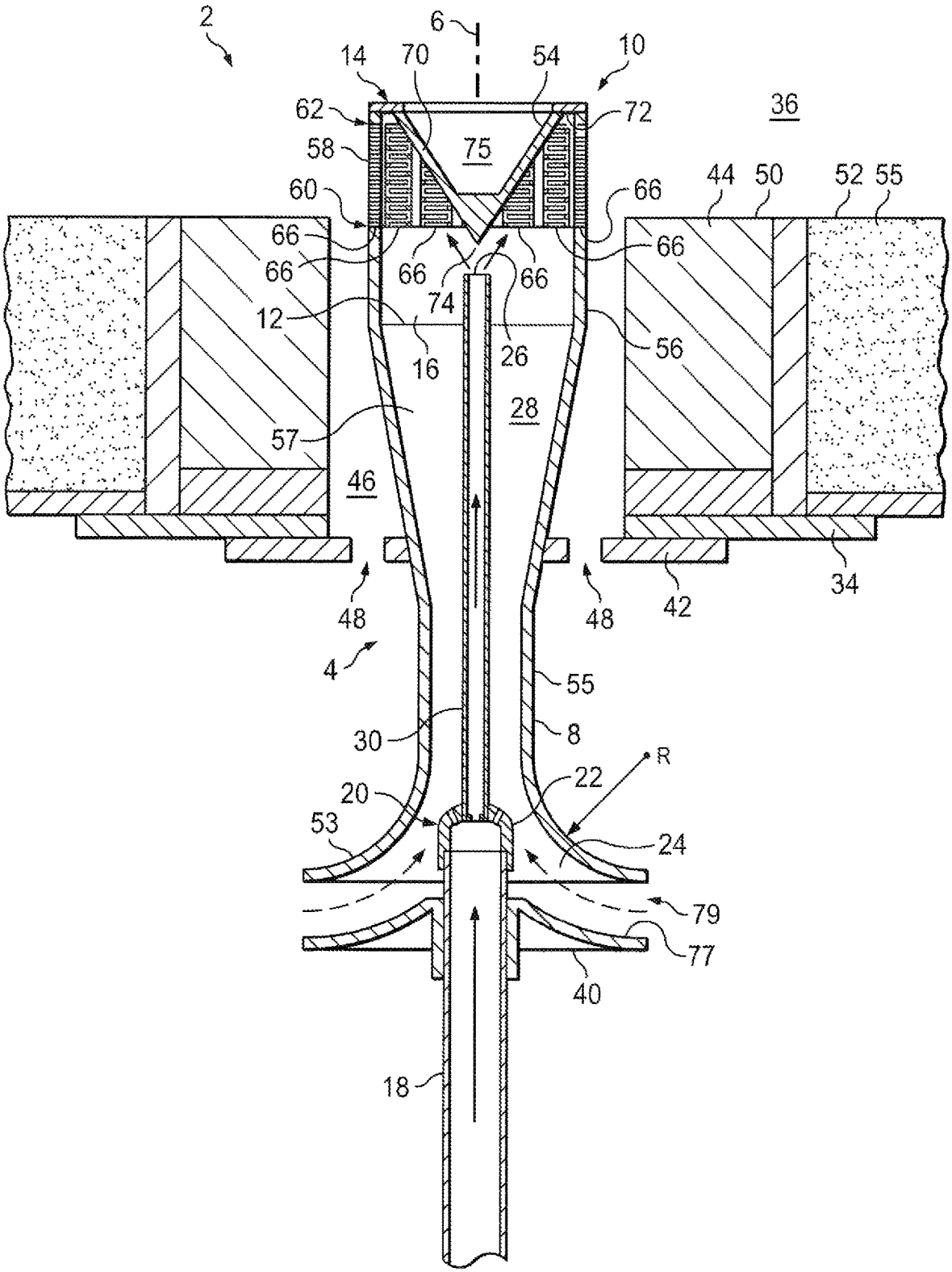
FIG. 1 is a cutaway elevational view of an embodiment 2 of the staged, fuel lean pre-mix, radiant wall burner provided by the present invention.

An embodiment 2 of the inventive pre-mix, staged fuel, radiant wall burner is illustrated in FIG. 1. The inventive radiant wall burner 2 preferably comprises: (a) a primary fuel tip assembly 4 which has a longitudinal axis 6 and comprises a venturi 8 and a radial discharge tip 10 which is positioned on or forwardly of the longitudinally forward discharge end 12 of the venturi 8; (b) a flow diverter 14 positioned in the interior 16 of the radial discharge tip 10; (c) a gas fuel line 18 which delivers a gas fuel supply stream to a gas fuel distribution nozzle or other distributor device 20 which divides the gas fuel supply stream into a primary gas fuel stream and a staged gas fuel stream; (d) a gas fuel spud or other primary fuel ejector 22 which forms or is part of the gas fuel distributor 20 and includes one or more (preferably a plurality of) fuel discharge ports 33 for ejecting the primary fuel stream into the longitudinally rearward inlet end 24 of the venturi 8; (e) a staged fuel discharge tip 26 positioned in the interior 28 of the primary fuel tip assembly 4 at a longitudinal position which is forward of the primary fuel ejector 22 and rearward of the flow diverter 14; (f) a riser or other staged fuel conduit 30 which extends longitudinally within the interior 28 of the primary fuel tip assembly 4 from the gas fuel distributor 20 to the staged fuel discharge tip 26, which is located at the distal end of the staged fuel conduit 30, for delivering the staged gas fuel stream to the staged tip 26; and (g) a staged fuel flow orifice 32 which regulates the amount of staged gas fuel which flows through the staged fuel conduit 30 and is discharged from the staged fuel discharge tip 26.

The inventive pre-mix radiant wall burner 2 is illustrated in FIG. 1 as being vertically installed through a bottom wall (i.e., the floor) 34 of the combustion chamber 36 of a fired heater. It will be understood, however, that the inventive burner 2 can alternatively be installed in a side wall or a ceiling of the combustion chamber 36 and can be oriented horizontally, upwardly, downwardly, or at generally any other desired angle. The combustion chamber 36 is filled with gaseous inert products of combustion (flue gas) produced in the combustion chamber 36 by the burner combustion process.

The inventive pre-mix radiant wall burner 2 preferably further comprises: a primary air door 40 positioned around the fuel distributor 20 at, inside of, or rearwardly of the rearward inlet end 24 of the venturi 8 for directing and regulating a primary combustion air flow into the rearward inlet end 24 of the venturi 8; an attachment plate or bracket 42, through which the venturi 8 extends, which is attached to the wall 34 of the combustion chamber 36; a burner wall 44, installed on or in the furnace wall 34 inside the combustion chamber 36, which surrounds the primary fuel tip assembly 4 such that annular gap 46 is formed between the primary fuel tip assembly 4 and the burner wall 44; secondary air openings 48 which are formed through the attachment plate 42 to provide a secondary flow of combustion air into and through the annular gap 46 surrounding the exterior of the primary fuel tip assembly 4; and a secondary air door (not shown) which regulates the flow of secondary combustion air through the secondary air openings 48. Although other structures and materials of construction can alternatively be used, the burner wall 44 will preferably be constructed of a high temperature refractory burner tile material. The forward end 50 of the burner wall 44 will preferably be even with, or will extend slightly beyond, the radiating inner surface 52 of the furnace insulating material 55 which covers the interior of the furnace wall 34.

The venturi 8 preferably comprises: a contoured inlet bell section 53 having a bell radius R; a straight, preferably cylindrical, throat section 55 which extends forwardly from the inlet bell section 53; and an outlet section 57 which diverges outwardly, preferably in the form of a section of a cone, as it extends forwardly from the throat section 55.

The radial discharge tip 10 can be installed on the forward discharge end 12 of the venturi 8 or can alternatively be positioned forwardly of the discharge end 12 of the venturi 8 on, e.g., an extension tube or other component which is installed in the primary fuel tip assembly 4 between the venturi 8 and the radial discharge tip 10. The radial discharge tip 10 preferably comprises: a closed forward end 54; a longitudinally extending side wall 56 which surrounds the longitudinal axis 6; and a radial discharge segment 58 which is formed in the side wall 56 of the radial discharge tip 10 for radially discharging both (i) the primary fuel and air pre-mix stream formed in the venturi 8 and (ii) the staged gas fuel stream which is discharge within the interior 28 of the primary fuel tip assembly 4 by the staged fuel tip 26.

The radial discharge segment 58 of the radial discharge tip 10 surrounds the longitudinal axis 6 and extends longitudinally in the side wall 56 of the burner tip 10 from a rearward end 60 to a forward end 62 of the radial discharge segment 58. When the inventive burner 2 is installed in the wall 34 of the combustion chamber 36, the rearward end 60 of the radial discharge segment 58 of the radial discharge tip 10 will preferably be positioned at least slightly forward of the forward end 50 of the burner wall 44 and of the radiating inner surface 52 of the wall 34 of the combustion chamber 36.

The radial discharge segment 58 comprises a plurality of openings which are formed through the side wall 56 and which are preferably provided the entire distance around the side wall 56 and also along the entire longitudinal distance from the rearward end 60 to the forward end 62 of the radial discharge segment. The openings can be circular holes, holes having other shapes, longitudinally extending slots, lateral slots, slots having other orientations, openings having other configurations, or combinations thereof.

Figure 2:
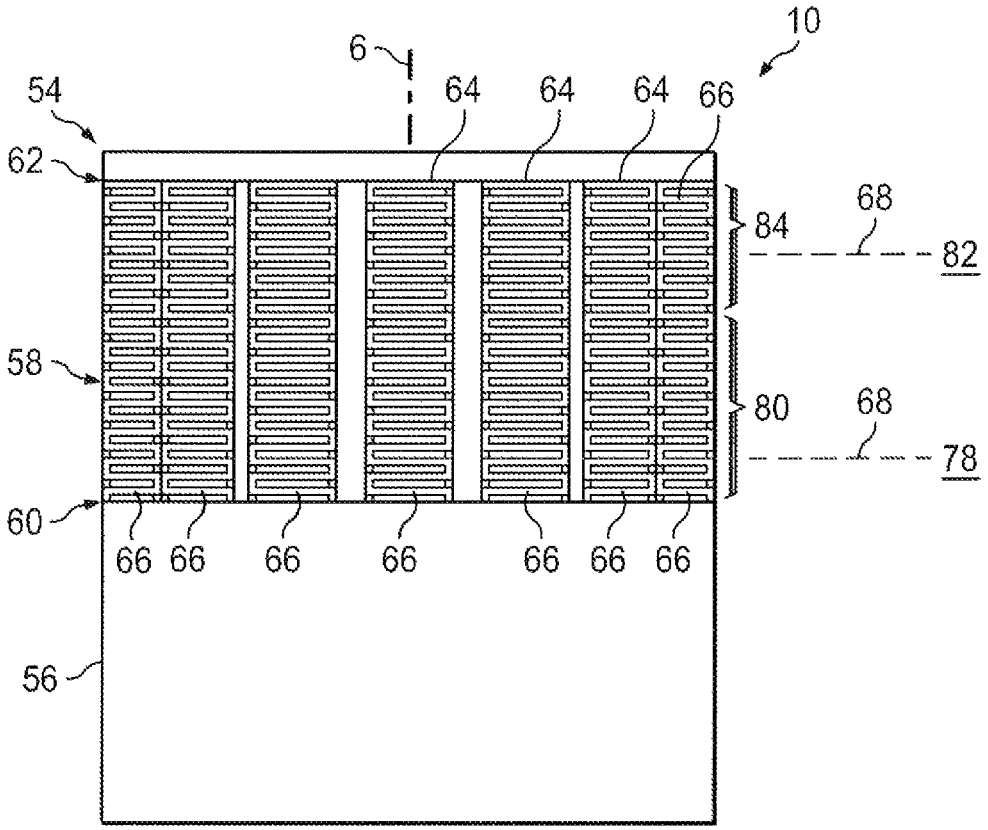
FIG. 2 is an elevational side view of a radial discharge tip 10 used in the inventive radiant wall burner 2.
Figure 3:
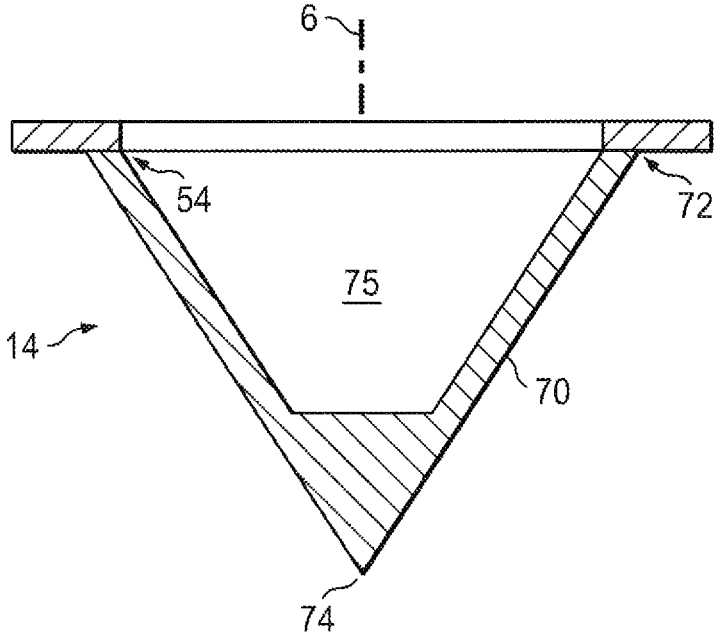
FIG. 3 is a cutaway elevational side view of a flow diverter 14 used in the inventive radiant wall burner 2.
Figure 4:
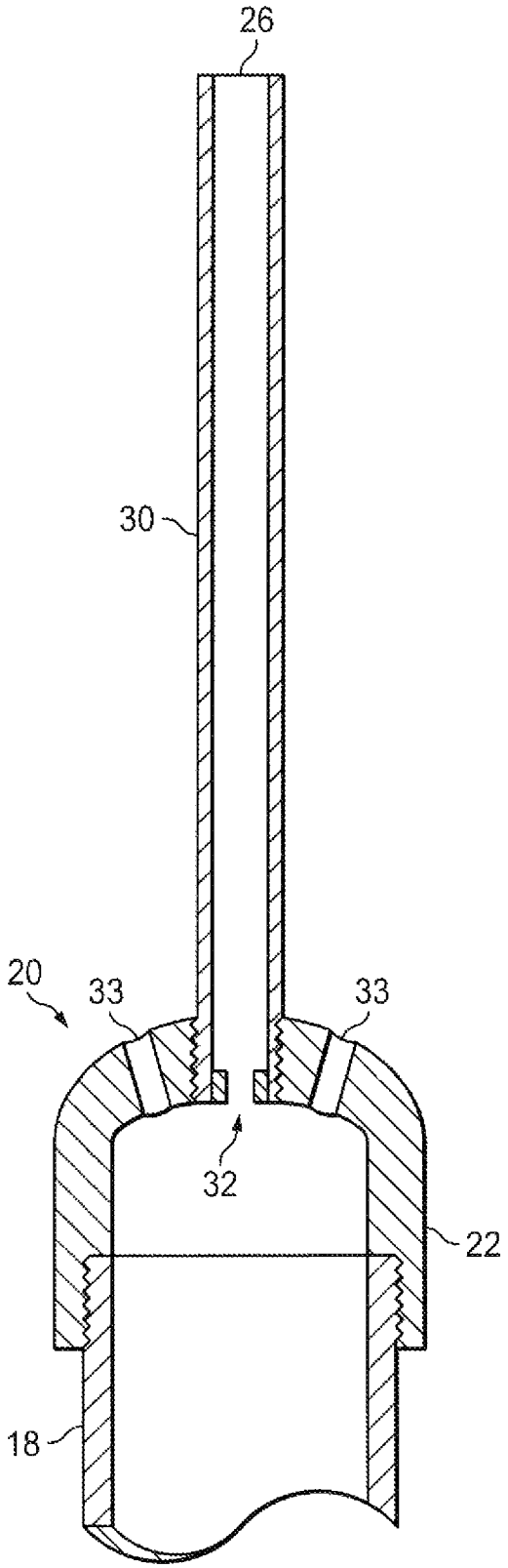
FIG. 4 illustrates a fuel gas distribution nozzle 20 used in the inventive radiant wall burner 2.

As illustrated in FIG. 2, the openings formed through the side wall 56 of the radial discharge tip 10 will preferably comprise a longitudinally extending series of rows 66 of surrounding discharge slots 64. Each of the rows 66 of surrounding slots 64 surrounds the longitudinal axis 6. In addition, each of the rows 66 of surrounding slots 64 lies in a different plane 68 which is substantially perpendicular to the longitudinal axis 6 (i.e., within ±5°) such that, when the longitudinal axis 6 is vertically positioned, the surrounding discharge slots 64 of each of the rows 66 of surrounding slots 64 are substantially horizontal. The use of a longitudinally extending series of rows 66 of surrounding discharge slots 64 in the radial discharge tip 10 (*a*) assists in eliminating low velocity areas near the rearward end 60 of the radial discharge segment 58 of the radial discharge tip 10, (b) assists in providing a more even discharge velocity along the entire length of the radial discharge segment 58, and (c) provides a greater flow discharge area in the radial discharge tip 10 without flashback.

The internal staged fuel discharge tip 26 can be simply an open distal end of the internal staged fuel conduit 30 or can be a tip with directional openings. The staged fuel discharge tip 26 will preferably be an opening in the distal end of the conduit 30.

As the pre-mix primary fuel/air stream and the staged gas fuel stream flow forwardly in the primary fuel tip assembly 4, the flow diverter 14 positioned in the interior 16 of the radiant wall burner tip 10 operates to deflect these streams outwardly, at an angle away from the longitudinal axis 6, toward the radial discharge segment 58 formed around the side wall 56 of the radial discharge tip 10. The deflection of the pre-mix primary fuel/air stream and the staged gas fuel stream in this manner functions to equalize the discharge flow velocity along the entire longitudinal length of the radial discharge segment 58 and to eliminate low velocity areas near the rearward end 60 thereof.

The flow diverter 14 preferably comprises a deflecting wall 70 which (i) extends rearwardly in the interior 16 of the radial discharge tip 10 and (ii) converges radially inward toward the longitudinal axis 6 as it extends rearwardly. Most preferably, the deflecting wall 70 has a conical shape. The deflecting wall 70 extends rearwardly in the interior 16 of the radial discharge tip 10 from a forward base end 72 of the deflecting wall 70 which is longitudinally even with, or longitudinally forward of, the forward end 62 of the radial discharge segment 58 of the radial discharge tip 10. The deflecting wall 70 extends rearwardly from its forward base end 72 to a point 74 on the longitudinal axis 6 which (a) is longitudinally between the forward end 62 and the rearward end 60 of the radial discharge segment 58 so that the deflecting wall is 70 is surrounded by at least a forward portion, more preferably at least a forward half, of the radial discharge segment 58 or (b) is more preferably rearward of the rearward end 60 of the radial discharge segment 58 so that the deflecting wall 70 is surrounded by the entire radial discharge segment 58 and all of the discharge slots 64 or other openings therein.

The flow diverter 14 and the rearwardly extending deflecting wall 70 thereof will preferably be formed by the interior wall of the closed forward end 54 of the radial discharge tip 10. Along with the rearwardly extending interior deflecting wall 70, a rearwardly extending cavity 75 is preferably formed in the exterior of the closed forward end 54 of the radial discharge tip 10 in order to further reduce the temperature of the closed forward end 54, which is cooled by the gas fuel and air within the radial discharge tip 10 which contacts the rearwardly extending deflecting wall 70, to reduce or eliminate coking.

Alternatively, the flow diverter 14 and the deflecting wall 70 thereof can be provided by a device or structure within the interior 16 of the radial discharge tip 10 which is different from the closed forward end on the radial discharge tip 10. Also, as another alternative, the inventive pre-mix radiant wall burner 2 can be operated without a flow diverter 14 or a rearwardly extending deflecting wall 70 in the radial discharge tip 10.

The forward wall 77 of the primary air door 40 preferably has a contoured shape which matches or corresponds to the shape and the radius of curvature R of the inlet bell 53 of the venturi 8. This reduces the pressure drop which occurs in the inlet air channel 79 formed between the primary air door 40 and the inlet bell 53, increases the air flow into the venturi 8, and provides better control of the air flow during turndowns. The primary air door 40 can be adjusted to increase or reduce the size of the inlet air channel 79 by movement towards the rearward inlet 24 of the venturi 8 for reduction and away from the venturi inlet 24 for an increased air channel.

In the method of the present invention using the inventive the pre-mix radiant wall burner 10, a gas fuel supply stream is delivered through the gas fuel line 18 to the fuel distributor 20. The fuel distributor 20 divides the fuel supply stream into a primary gas fuel stream and a staged gas fuel stream. The staged flow orifice 32 or other distributor element(s) of the flow distributor 20 will preferably be sized or operate to divide the gas fuel supply stream such that (a) the amount of the staged fuel stream is in the range of from 20% to 40%, more preferably about 30% (i.e., 30%±3%), by volume of the total volume of the gas fuel supply stream and (b) the amount of the primary fuel stream is in the range of from 80% to 60% by volume of the total volume of the gas fuel supply stream.

The primary gas fuel stream is ejected forwardly by the primary fuel ejector 22 into the rearward inlet end 24 of the venturi 8. The momentum of the ejected primary fuel stream draws a primary combustion air stream into the rearward inlet end 24 of the venturi 8. As the primary gas fuel stream and the primary air stream flow forwardly in the venturi 8 to the radial discharge tip 10, the primary air mixes with the primary fuel stream to form a fuel lean, pre-mix fuel/air stream. The relative size and dimensions of the venturi 8 will preferably be such that a sufficient amount of primary combustion air is drawn into the venturi 8 to provide an oxygen level in the fuel lean pre-mix stream which is in the range of from about 6% to about 12%, more preferably about 8% (i.e., 8%±1%), by volume in excess of the amount of oxygen needed for stoichiometric combustion of the primary gas fuel stream. The amount of excess air in the fuel lean pre-mix stream can be further regulated as needed by adjusting the primary air door 40.

The staged fuel stream flows through the staged fuel conduit 30 and is discharged forwardly into the interior 28 of the primary fuel tip assembly 4 from the staged fuel discharge tip 26. The staged fuel discharge tip 26 can be located in the throat section 55 or the outlet section 57 of the venturi 8, or in the radial discharge tip 10. When the lean pre-mix stream and the staged fuel stream reach the flow diverter 14, they are deflected by the deflecting wall 70 of the flow diverter 14 outwardly at an angle away from the longitudinal axis 6 and toward the radial discharge segment 58 of the radial discharge tip 10. The lean pre-mix stream and the staged fuel stream are then radially discharged from the rows 66 of surrounding slots 64 or other openings of the radial discharge segment 58 and are combusted outside of the radial discharge tip 10.

As mentioned above, the flow diverter 14, and the preferred use of rows 66 of surrounding discharge slots 64 in the radial discharge tip 10, operate to equalize the discharge velocity along the entire longitudinal length of the radial discharge segment 58 and to eliminate low velocity areas, thus preventing flashback and allowing the use a gas fuel having a higher $H_2$ content.

In order to (i) provide greater flue gas mixing with the staged gas fuel stream (i.e., greater internal flue gas recirculation (IFGR)), for reduced $NO_x$ emissions, (ii) reduce the diameter of the burner flame in order to allow the inventive burners 2 to be spaced closer together, and (iii) further enhance the ability of the inventive burner 2 to combust high hydrogen fuels without flashback, the staged fuel discharge tip 26 will preferably be located in the radial discharge tip 10 close to the rearward end 74 of the deflecting wall 70 of the flow diverter 14.

The positioning of the staged fuel tip 26 in the radial discharge tip 10 in proximity to the rearward end 74 of the flow diverter 14 desirably allows some, but less than a stoichiometric amount, of oxygen within the primary fuel tip assembly 4 to mix with the staged fuel stream prior to the staged fuel steam being discharged from the radial discharge tip 10. In addition, the positioning of the staged fuel tip 26 in the radial discharge tip 10 in proximity to the rearward end 74 of the flow diverter 14 causes the fuel lean pre-mix stream and the fuel rich staged fuel stream to be discharge from the radial discharge tip 10 in a manner such that (a) a radial flow 78 of a fuel lean gas fuel and air mixture, dominated by the lean pre-mix, is discharge from a longitudinally rearward portion 80 of the radial discharge segment 58 of the radial discharge tip 10 and (b) an outer radial flow 82 of a fuel rich mixture dominated by the staged gas fuel stream is discharged from a longitudinally forward portion 84 of the radial discharge segment 58.

The fuel lean radial flow 78 ignites and begins combustion immediately upon discharge from the radial fuel discharge tip 10, but at a reduced combustion temperature due to the excess air content of the radial flow 78, which reduces $NO_x$ emissions. At the same time, at least most of the outer radial flow 82 of the fuel rich mixture discharged from the forward portion 84 of the radial discharge segment 58 mixes and is conditioned with inert flue gas in the combustion chamber 36 prior to mixing and burning with the oxygen rich radial flow 78, thus further reducing $NO_x$ emissions.

In addition, the small amount of air/oxygen which mixes with the staged fuel stream and is included in the fuel rich outer radial flow 82 desirably reduces the diameter of the flat radial flame produced by the inventive staged, lean pre-mix radiant wall burner 2 by approximately 10% to 50% depending on the amount of staged gas and tip exit velocity.

In the event that the momentum of the fuel gas ejected from the primary spud 22 is not sufficient to pull into the venturi 8 enough air for complete combustion, secondary air can be pulled into the secondary air openings 48 by means of furnace draft. The secondary air control allows for the adjustment of this additional air in order to control the amount of excess combustion air to the desired level.

Because of the combination of the improvements discussed above, the inventive staged, lean pre-mix radiant wall burner 2 can burn a gas fuel with a hydrogen content of 75% or more by volume, and can burn a gas fuel having a hydrogen content of 90% by volume and higher in the more preferred embodiments of the burner 2, without flashbacks.

Although the lateral cross-sectional shape of the venturi 8, the radial discharge tip 10, and the burner wall 44 of the inventive burner 2 will typically be circular, it will be understood that the inventive radiant wall burner 2 can alternatively have a rectangular, elliptical, oval, or other non-circular cross-sectional shape.

Thus, the present invention is well adapted to carry out the objectives and attain the ends and advantages mentioned above as well as those inherent therein. While presently preferred embodiments and steps have been described for purposes of this disclosure, the invention is not limited in its application to the details of the preferred embodiments and steps. Numerous changes and modifications will be apparent to those in the art. Such changes and modifications are encompassed within this invention as defined by the claims. In addition, unless expressly stated, the phraseology and terminology employed herein are for the purpose of description and not of limitation.

What is claimed is:

1. A radiant wall burner comprising:

a primary fuel tip assembly comprising a longitudinal axis, a venturi having a longitudinally rearward inlet end and a longitudinally forward discharge end, a radial discharge tip positioned on or forwardly of the longitudinally forward discharge end of the venturi, the radial discharge tip having a closed longitudinally forward end and a longitudinally extending side wall which surrounds the longitudinal axis, and a plurality of surrounding openings, formed through the longitudinally extending side wall of the radial discharge tip, which surround the longitudinal axis;

a primary fuel ejector which ejects a primary gas fuel stream into the venturi and draws an air stream into the longitudinally rearward inlet end of the venturi which mixes with the primary gas fuel stream to form a pre-mix stream;

a staged fuel discharge tip which discharges a staged gas fuel stream, the staged fuel discharge tip being positioned in an interior of the primary fuel tip assembly longitudinally forward of the primary fuel ejector and longitudinally rearward of the closed longitudinally forward end of the radial discharge tip;

a gas fuel distributor through which a gas fuel supply stream is divided into the primary gas fuel stream which is ejected from the primary fuel ejector and the staged gas fuel stream;

a staged fuel conduit through which the staged gas fuel stream flows, the staged fuel discharge tip being located on a distal end of the staged fuel conduit and the staged fuel conduit extending longitudinally within the interior of the primary fuel tip assembly from the gas fuel distributor; and the gas fuel distributor regulating the amount of the staged gas fuel stream to from 20% to 40% by volume of the gas fuel supply stream.

2. The radiant wall burner of claim 1 further comprising a flow diverter in an interior of the radial discharge tip which deflects the pre-mix stream and the staged gas fuel stream outwardly, at an angle away from the longitudinal axis, toward the surrounding openings of the radial discharge tip and the staged fuel discharge tip being positioned longitudinally rearward of the flow diverter.

3. The radiant wall burner of claim 2 further comprising the flow diverter comprising a deflecting wall which (i) extends rearwardly in the interior of the radial discharge tip and (ii) converges radially inward toward the longitudinal axis as it extends rearwardly.

4. The radiant wall burner of claim 3 further comprising the deflecting wall having a conical shape.

5. The radiant wall burner of claim 3 further comprising the staged fuel discharge tip being positioned in the interior of the radial discharge tip.

6. The radiant wall burner of claim 3 further comprising the deflecting wall being an interior wall of the closed forward longitudinal end of the radial discharge tip.

7. The radiant wall burner of claim 6 further comprising the closed longitudinally forward end of the radial discharge tip having a rearwardly extending exterior cavity formed therein.

8. The radiant wall burner of claim 3 further comprising the deflecting wall being surrounded by the surrounding openings formed through the side wall of the radial discharge tip and the deflecting wall extending rearwardly to a point on the longitudinal axis which is longitudinally rearward of the surrounding openings formed through the side wall of the radial discharge tip.

9. The radiant wall burner of claim 1 further comprising the surrounding openings formed through the side wall of the radial discharge tip comprising a longitudinal series of rows of surrounding slots, each of said rows of surrounding slots surrounding the longitudinal axis and each of said rows of surrounding slots lying in a different plane which is substantially perpendicular to the longitudinal axis such that, when the longitudinal axis is vertically positioned, the surrounding slots of each of said rows of surrounding slots are substantially horizontal.

10. A radiant wall burner comprising:

a primary fuel tip assembly comprising
- a longitudinal axis,
- a venturi having a longitudinally rearward inlet end and a longitudinally forward discharge end,
- a radial discharge tip positioned on or forwardly of the longitudinally forward discharge end of the venturi,
- the radial discharge tip having a closed longitudinally forward end and a longitudinally extending side wall which surrounds the longitudinal axis, and
- a longitudinal series of rows of surrounding slots formed through the side wall of the radial discharge tip, each of said rows of surrounding slots surrounding the longitudinal axis and each of said rows of surrounding slots lying in a different plane which is substantially perpendicular to the longitudinal axis such that, when the longitudinal axis is vertically positioned, the surrounding slots in each of said rows of surrounding slots are substantially horizontal;

a primary fuel ejector which ejects a primary gas fuel stream into the venturi and draws an air stream into the longitudinally rearward inlet end of the venturi which mixes with the primary gas fuel stream to form a pre-mix stream;

a flow diverter in an interior of the radial discharge tip, the flow diverter comprising a deflecting wall which (i) extends rearwardly in the interior of the radial discharge tip, (ii) converges radially inward toward the longitudinal axis as it extends rearwardly, and (iii) is laterally surrounded by at least some of the rows of surrounding slots; and a staged fuel discharge tip which discharges a staged gas fuel stream, the staged fuel discharge tip being positioned in an interior of the primary fuel tip assembly longitudinally forward of the primary fuel ejector and longitudinally rearward of the deflecting wall of the flow diverter.

11. A method of operating a radiant wall burner having a primary fuel tip assembly comprising (i) a longitudinal axis, (ii) a venturi having a longitudinally rearward inlet end and a longitudinally forward discharge end, (iii) a radial discharge tip positioned on or forwardly of the longitudinally forward discharge end of the venturi, (iv) the radial discharge tip having a closed longitudinally forward end and a longitudinally extending side wall which surrounds the longitudinal axis, and (v) the side wall of the radial discharge tip having a longitudinally extending radial discharge segment formed therein which surrounds the longitudinal axis, the method comprising discharging from a longitudinally rearward portion of the radial discharge segment a fuel-lean gas fuel and air mixture comprising more than a stoichiometric amount of oxygen, and discharging from a longitudinally forward portion of the radial discharge segment a fuel rich flow comprising less than a stoichiometric amount of or no oxygen, by:

ejecting, from a primary fuel ejector, a primary gas fuel stream into the longitudinally rearward inlet end of the venturi, the ejection of the primary gas fuel stream drawing an air stream into the longitudinally rearward inlet end of the venturi which mixes with the primary gas fuel stream to form a lean premix stream;

forwardly discharging from a staged fuel discharge tip, located in an interior of the primary fuel tip assembly, a staged gas fuel stream, the staged fuel discharge tip being positioned longitudinally forward of the primary fuel ejector and longitudinally rearward of a flow diverter in an interior of the radial discharge tip; and deflecting, from a deflecting wall of the flow diverter, the lean premix stream and the staged gas fuel stream outwardly, at an angle away from the longitudinal axis, in the interior of the radial discharge tip toward the longitudinally extending radial discharge segment.

12. The method of claim 11 further comprising the deflecting wall of the flow diverter (i) extending rearwardly in the interior of the radiant wall burner tip and (ii) converging radially inward, toward the longitudinal axis, as it extends rearwardly.

13. The method of claim 12 further comprising the staged fuel discharge tip being positioned in the interior of the radial discharge tip.

14. The method of claim 13 further comprising the deflecting wall of the flow diverter having a conical shape.

15. The method of claim 13 further comprising the deflecting wall being surrounded by the longitudinally extending radial discharge segment formed in the side wall of the radial discharge tip and the deflecting wall extending rearwardly in the radial discharge tip to a point on the longitudinal axis which is longitudinally rearward of the radial discharge segment.

16. The method of claim 11 further comprising the radial discharge segment, formed in the side wall of the radial discharge tip, comprising a longitudinal series of rows of surrounding slots, each of said rows of surrounding slots surrounding the longitudinal axis and each of said rows of surrounding slots lying in a different plane which is substantially perpendicular to the longitudinal axis such that, when the longitudinal axis is vertically positioned, the surrounding slots of each of said rows of surrounding slots are substantially horizontal.

17. The method of claim 16 further comprising:

delivering a gas fuel supply stream to a gas fuel distributor which divides the gas fuel supply stream into the primary gas fuel stream which is ejected from the primary fuel ejector and the staged gas fuel stream;

delivering the staged gas fuel stream from the gas fuel distributor to the staged fuel discharge tip via a staged fuel conduit which extends longitudinally within the interior of the primary fuel tip assembly; and regulating the staged gas fuel which is delivered via the staged fuel conduit to the staged fuel discharge tip to an amount which is from 20% to 40% by volume of the gas fuel supply stream.

18. The method of claim 16 further comprising:

the gas fuel supply stream comprising at least 75% by volume of hydrogen;

the longitudinally rearward portion of the radial discharge segment including at least five rearward-most ones of the rows of surrounding slots; and the fuel-lean gas fuel and air mixture and the fuel rich flow being combusted outside of the radiant wall burner tip without any flashback occurring in any portion of the longitudinally rearward portion of the radial discharge segment.

19. A radiant wall burner comprising:

a primary fuel tip assembly comprising a longitudinal axis, a venturi having a longitudinally rearward inlet end and a longitudinally forward discharge end, a radial discharge tip positioned on or forwardly of the longitudinally forward discharge end of the venturi, the radial discharge tip having a longitudinally forward end and a longitudinally extending side wall which surrounds the longitudinal axis, and a plurality of surrounding openings, formed through the longitudinally extending side wall of the radial discharge tip, which surround the longitudinal axis;

a primary fuel ejector which ejects a primary gas fuel stream into the venturi and draws an air stream into the longitudinally rearward inlet end of the venturi which mixes with the primary gas fuel stream to form a pre-mix stream;

a staged fuel discharge tip which discharges a staged gas fuel stream, the staged fuel discharge tip being positioned in an interior of the primary fuel tip assembly longitudinally forward of the primary fuel ejector and longitudinally rearward of the longitudinally forward end of the radial discharge tip; and the longitudinally forward end of the radial discharge tip being closed so that all of the pre-mix stream is radially discharged from the surrounding openings formed through the longitudinally extending side wall of the radial discharge tip and all of the staged gas fuel stream is also radially discharged from the surrounding openings formed through the longitudinally extending side wall of the radial discharge tip.

* * * * *